US012501980B2

(12) United States Patent
Zhang

(10) Patent No.: US 12,501,980 B2
(45) Date of Patent: Dec. 23, 2025

(54) ELECTRIC STORAGE TYPE HAIR STEAM PERM STRUCTURE

(71) Applicant: Yining Zhang, Shenzhen (CN)

(72) Inventor: Yining Zhang, Shenzhen (CN)

( * ) Notice: Subject to any disclaimer, the term of this patent is extended or adjusted under 35 U.S.C. 154(b) by 392 days.

(21) Appl. No.: 18/185,446

(22) Filed: Mar. 17, 2023

(65) Prior Publication Data

US 2024/0292934 A1 Sep. 5, 2024

(30) Foreign Application Priority Data

Mar. 2, 2023 (CN) ..... 202320459406.0

(51) Int. Cl.
*A45D 6/20* (2006.01)
*A45D 2/00* (2006.01)

(52) U.S. Cl.
CPC ..... *A45D 6/20* (2013.01); *A45D 2/001* (2013.01)

(58) Field of Classification Search
CPC . A45D 2/00; A45D 2/001; A45D 2/40; A45D 6/00; A45D 6/20; A45D 7/00; A45D 7/02; A45D 20/08; A45D 20/28; A45D 20/50; A45D 4/00; A45D 4/04; A45D 4/06; A45D 4/10; A45D 4/12; A45D 19/00; A45D 19/16
See application file for complete search history.

(56) References Cited

U.S. PATENT DOCUMENTS

| | | | | |
|---|---|---|---|---|
| 3,835,292 | A * | 9/1974 | Walter | A45D 2/36 392/404 |
| 4,326,545 | A * | 4/1982 | Motegi | A45D 1/18 132/229 |
| 11,571,056 | B2 * | 2/2023 | Min | A45D 20/00 |
| 11,832,700 | B2 * | 12/2023 | Udy | A45D 20/10 |
| 11,844,408 | B2 * | 12/2023 | Kim | A45D 20/26 |
| 12,317,983 | B1 * | 6/2025 | Day | A45D 2/001 |
| 2003/0055469 | A1 * | 3/2003 | Ohmura | A45D 20/50 607/109 |
| 2007/0107746 | A1 * | 5/2007 | Randolph | B26B 13/24 132/118 |
| 2019/0313759 | A1 * | 10/2019 | Fereyre | A45D 1/06 |
| 2020/0046101 | A1 * | 2/2020 | Fereyre | A45D 1/06 |
| 2022/0007808 | A1 * | 1/2022 | Zhou | A45D 2/001 |
| 2023/0301415 | A1 * | 9/2023 | Soresina | A45D 20/10 |
| 2023/0346099 | A1 * | 11/2023 | Jiang | A45D 20/12 |
| 2024/0122324 | A1 * | 4/2024 | Billingslea | A45D 1/04 |
| 2024/0398087 | A1 * | 12/2024 | Ishihara | A45D 20/12 |

* cited by examiner

*Primary Examiner* — Rachel R Steitz
*Assistant Examiner* — Karim Asqiriba
(74) *Attorney, Agent, or Firm* — JEEN IP LAW, LLC

(57) ABSTRACT

The invention discloses an electric storage type hair steam perm structure, in particular to the field of electric storage type hair steam perm structures, comprising a device main body, wherein the device main body comprises an upper clamping component and a lower clamping component which is rotatably connected with a rotating shaft of the upper clamping component; A steam generating device is installed in the upper clamping component shell.

10 Claims, 5 Drawing Sheets

ELECTRIC STORAGE TYPE HAIR STEAM PERM STRUCTURE

CROSS-REFERENCE TO RELATED APPLICATIONS

This is a U. S. patent application which claims the priority and benefit of Chinese Patent Application Number 202320459406.0, filed on Mar. 2, 2023, the disclosure of which is incorporated herein by reference in its entirety.

TECHNICAL FIELD

The invention relates to the technical field of electric storage type hair steam perm structures, and more specifically, the invention relates to an electric storage type hair steam perm structure.

BACKGROUND

Perming hair is a symbol of modern people's love for beauty, and it is also a fashion endorsement. In addition to professional perming hair in hair salons, many people will also have a perm device at home.

But at present, most hair straighteners and curlers on the market belong to dry perm products. If they are used for a long time or operated improperly, it is likely to cause hair damage.

At present, some products are spray or steam perm devices. However, due to the defects in its structure and heating control, the water droplets generated by high-temperature steam are easy to drip out and burn the scalp during use. Moreover, all these products are powered by wired 220V, which poses the risk of electric shock. It is not convenient to use and needs to be improved.

SUMMARY

Aiming at the technical problem that the solution in the prior art is too simple, the technical scheme of the invention provides a solution which is obviously different from the prior art. In order to overcome the above defects in the prior art, the present invention provides an electric storage type hair steam perm structure to solve the problems raised in the above background technology.

In order to achieve the above purpose, the invention provides the following technical scheme: an electric storage type hair steam perm structure comprises a device main body, wherein the device main body comprises an upper clamping assembly and a lower clamping assembly rotatably connected with a rotating shaft of the upper clamping assembly.

A steam generator is installed in the upper clamping assembly shell.

The steam generator comprises an upper steam ironing board, wherein the upper steam ironing board is provided with a steam tank, the bottom of the steam tank is provided with a plurality of groups of air holes, a metal heat conductor is arranged in the steam tank, a cavity is arranged in the metal heat conductor, a first heating plate is arranged in the cavity, and metal cover plates which are in contact with each other are arranged above the metal heat conductor.

A plurality of water tanks are horizontally and vertically arranged on the surface part and the bottom part of the metal heat conductor.

The two sides of the metal heat conductor are also provided with one or more water tanks horizontally and vertically.

The working voltage of the first heating plate is set to 11-13V\.

The metal cover plate is provided with a first heat shield; The upper surface of the first heat shield is provided with a temperature sensor and a metal water inlet, the temperature sensor penetrates through the first heat shield to contact with the metal cover plate, and the metal water inlet penetrates through the first heat shield to communicate with the metal cover plate and the steam tank.

One end of the temperature sensor is electrically connected with a control panel, and the control panel is provided with a display screen, a temperature control chip, a function switch key and an adaptive driving circuit, wherein the display screen and the function switch key penetrate through the shell of the upper clamping assembly, and the control panel is installed above the first heat shield.

One side of the control panel is provided with a battery assembly, and the battery assembly comprises one or more batteries, a battery protection plate and a charging socket which are installed at one side of the batteries and are electrically connected.

The device main body also comprises a water pump, and the water outlet port of the water pump is connected with a metal water inlet through a connecting pipeline.

After the main body of the device is started, when the temperature control chip on the control panel detects that the temperature on the metal heat conductor is lower than the set temperature through the temperature sensor, the first heating plate starts to work; when the temperature on the metal heat conductor is higher than 100 degrees, the control panel reduces the working current of the first heating plate through an adaptive driving circuit; when the temperature on the metal heat conductor reaches 150-180 degrees, the first heating plate stops working; at this time, the water pump is started to pump water into the steam generator, and the water is vaporized at high temperature.

After the water enters the steam generator, it flows along the water tank on the metal heat conductor. By arranging a plurality of water tanks, the length of the water tank is extended, and the water is gasified more completely, so as to prevent the unvgasified high-temperature water from scalding the human body.

At the same time, it is safer and more convenient to drive the first heating plate with low voltage and use the built-in battery.

Preferably, the device main body further comprises a water tank, which is connected with the water inlet port of the water pump and installed at one side of the battery assembly.

Preferably, the lower clamping assembly comprises a bottom shell, the upper surface of the bottom shell is provided with a lower steam ironing board at a position corresponding to the upper steam ironing board; the surface of the lower steam ironing board is provided with a plurality of ventilation through holes.

Preferably, a second heating plate is installed below the lower steam ironing board, and the working voltage of the second heating plate is set to 11-13V.

Preferably, a second heat shield is installed outside the second heating plate, and a plurality of holes are also formed in the second heat shield, which are communicated with the air-permeable through holes on the lower steam ironing board.

Preferably, a negative ion generator is also arranged below the second heat shield, and the negative ion generator is electrically connected with the control panel; the negative ions released by the negative ion generator can not only smooth the short-tempered hair, but also neutralize static electricity and retain moisture in the hair.

Preferably, the metal water inlet is fixedly connected with the metal cover plate by screw thread.

Preferably, the metal cover plate is matched with the steam tank, and the metal cover plate is sealed and fixed on the steam tank by high-temperature resistant glue.

Preferably, the lower steam ironing board and the upper steam ironing board are arranged as flat-plate structures which are mutually attached up and down; the lower steam ironing board and the upper steam ironing board can also be arranged as arc-shaped structures which are convex at the top and concave at the bottom and are mutually meshed; the steam ironing board is matched with the upper steam ironing board.

Preferably, the device main body is specifically set as a hair straightener device and/or a hair curler device.

The invention has the technical effects and advantages that:

By arranging the steam generator, the control panel and the corresponding drive circuit, the main body of the device of the invention realizes the purpose of using steam perm to prevent the hair from being damaged by dry perm, and by extending the length of the water tank on the heating element, the water can be gasified more thoroughly in the cavity, thus effectively preventing the unvgasified high-temperature water in the cavity from flowing out and scalding the human body; at the same time, both the first heating plate and the second heating plate operate at low voltage, so that the use is safer, and the built-in battery design is very convenient to use.

The reference number is: 1 device main body; 2 upper clamping assembly; 3 lower clamping assembly; 21 steam generator; 211 metal heat conductor; 212 first heating plate; 2111 water tank; 213 metal cover plate; 214 first heat shield; 215 upper steam ironing board; 216 temperature sensor; 217 control panel; 218 charging socket; 2171 display screen; 2172 temperature control chip; 219 battery assembly; 2191 battery; 241 battery protection plate; 220 water pump; 221 metal water inlet; 222 water tank; 31 bottom shell; 32 lower steam ironing board; 33 second heating plate; 34 second heat shield, 35 negative ion generator, 2151 steam tank.

DETAILED DESCRIPTION

In the following, the technical scheme in the embodiment of the invention will be clearly and completely described with reference to the attached drawings. Obviously, the described embodiment is only a part of the embodiment of the invention, but not the whole embodiment. Based on the embodiments in the present invention, all other embodiments obtained by ordinary technicians in the field without creative labor belong to the scope of protection of the present invention.

Figure 1:
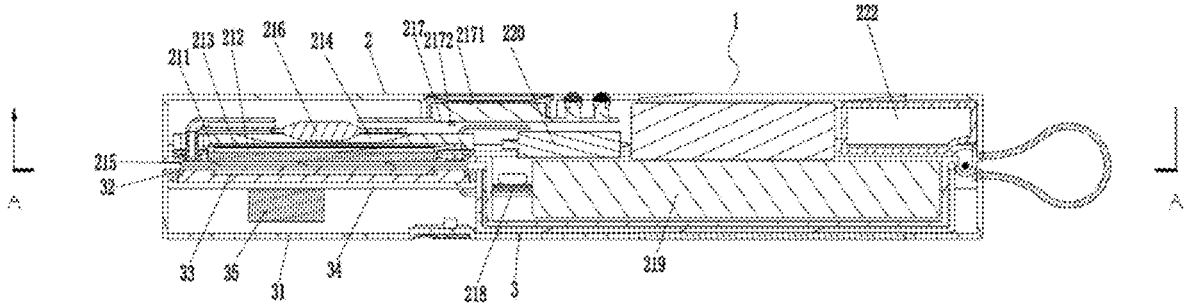
FIG. 1 is a cross-sectional view of that overall structure of the present invention.
Figure 2:
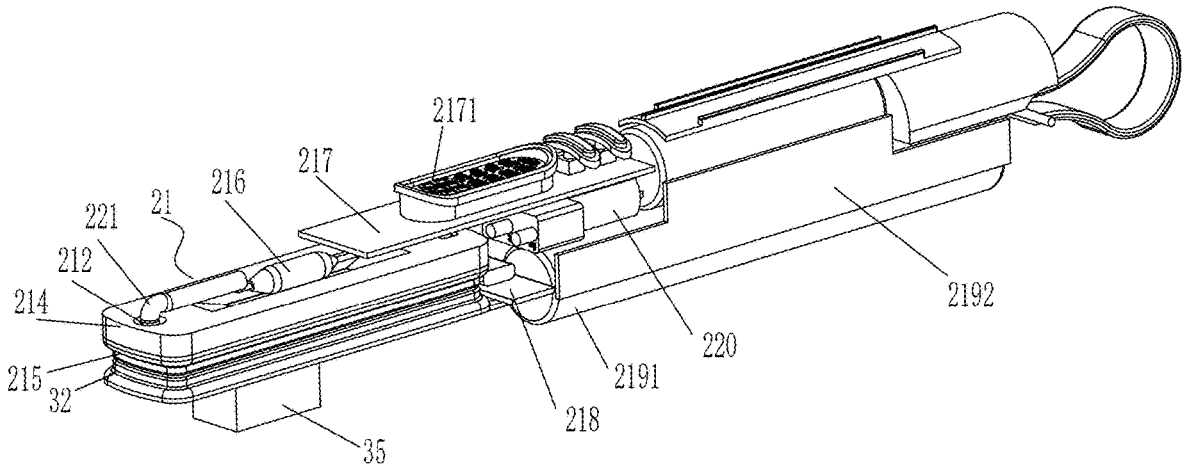
FIG. 2 is a schematic structural diagram of the steam generator in the present invention.
Figure 3:
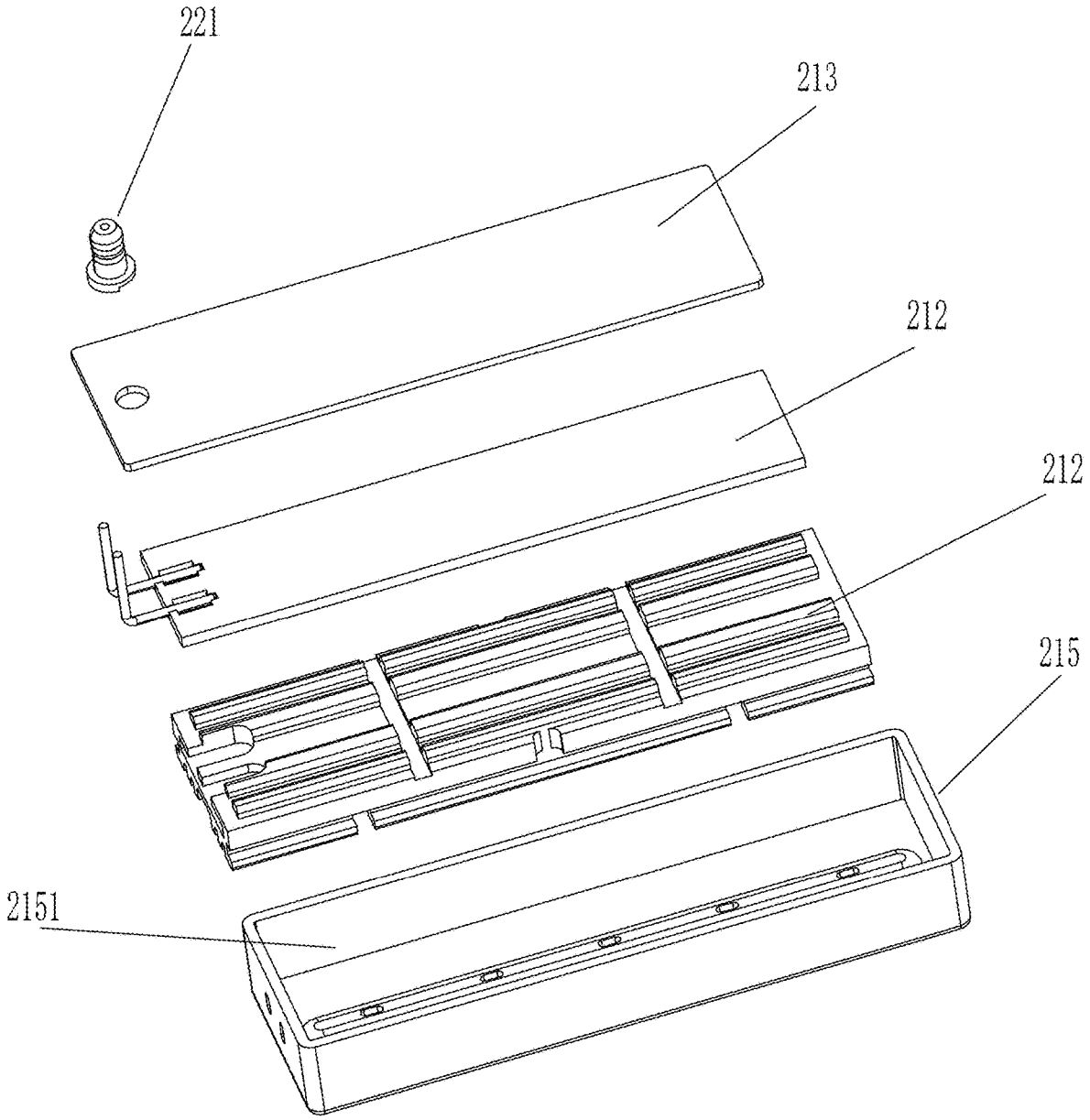
FIG. 3 is a schematic diagram of the structural explosion of the steam generator in the present invention.
Figure 4:
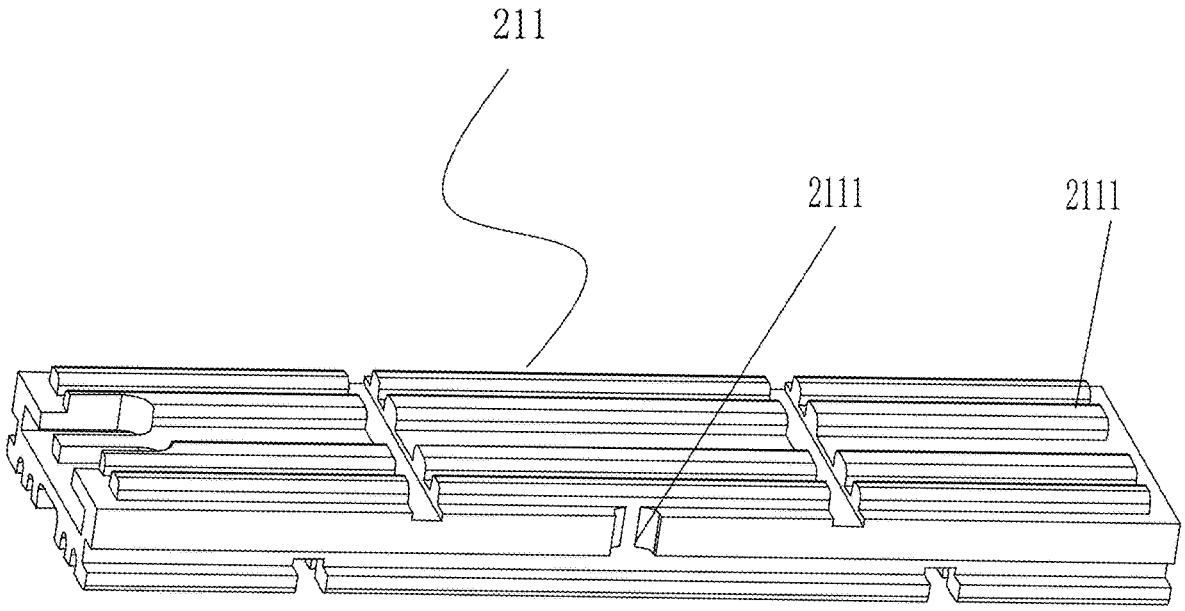
FIG. 4 is a schematic structural diagram of a metal heat conductor in the present invention.
Figure 5:
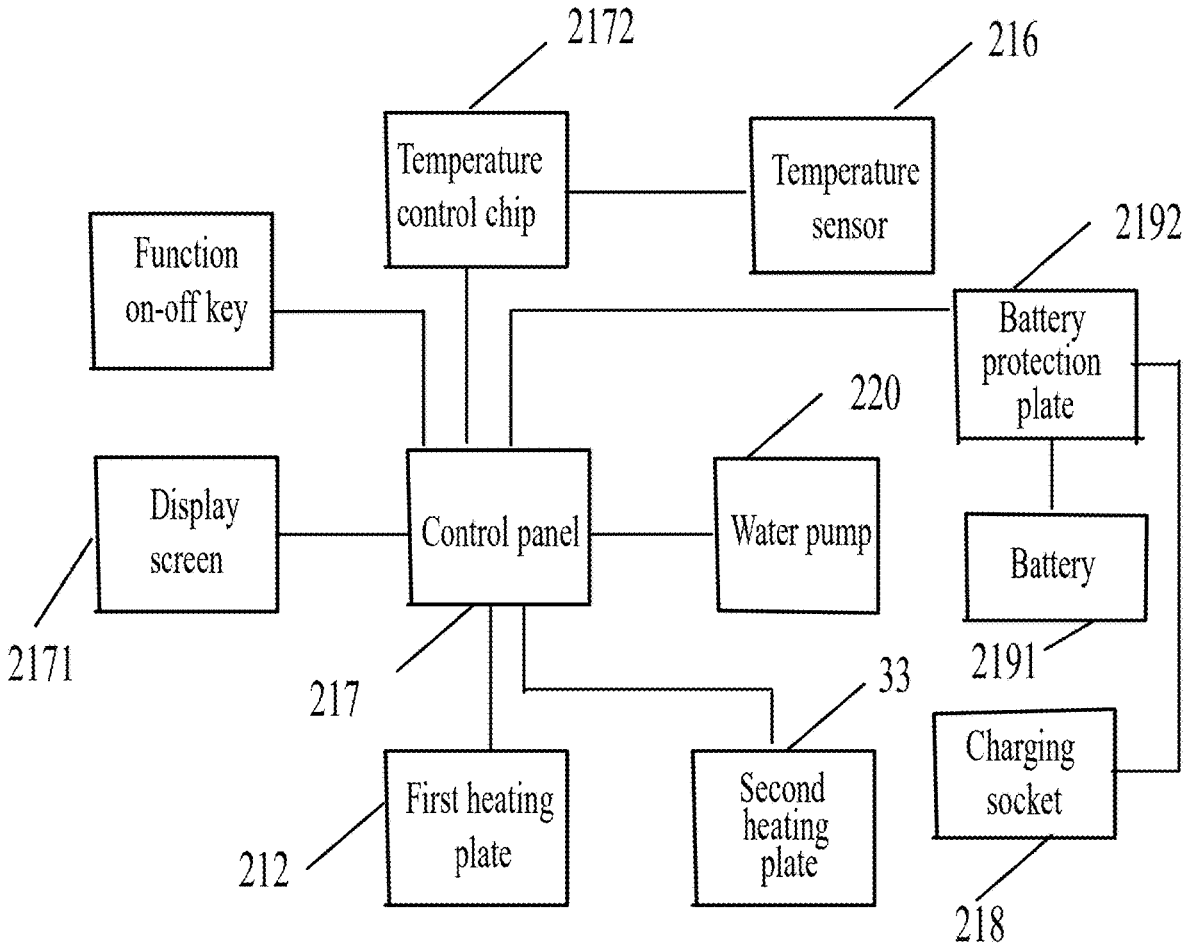
FIG. 5 is a block diagram of the working principle of the device main body of the present invention.

As shown in FIG. 1-5, an electric storage type hair steam perm structure comprises a device main body 1, where the device main body 1 comprises an upper clamping assembly 2 and a lower clamping assembly 3 rotatably connected with the rotating shaft of the upper clamping assembly 2. A steam generator 21 is installed inside the shell of the upper clamping assembly 2. The steam generator 21 comprises an upper steam ironing board 215, and the upper steam ironing board 215 is provided with a steam tank 2151, a bottom of the steam tank 2151 is provided with a plurality of air holes, and a metal heat conductor 211 is arranged in the steam tank 2151. There is a cavity in the metal heat conductor 211, in which the first heating plate 212 is installed, and a metal cover plate 213 contacting with each other is arranged above the metal heat conductor 211. A plurality of water tanks 2111 are horizontally and vertically arranged on the surface part and the bottom part of the metal heat conductor 211. One or more water tanks 2111 are formed on both sides of the metal heat conductor 211 horizontally and vertically, which effectively prolongs the length of the water tanks 2111, so that the water entering the steam generator 21 is heated more evenly and gasified more thoroughly. The operating voltage of the first heating plate 212 is set to 11-13V. The metal cover plate 213 is provided with a first heat shield 214. The upper surface of the first heat shield 214 is provided with a temperature sensor 216 and a metal water inlet 221. The temperature sensor 216 penetrates through the first heat shield 214 and contacts the metal cover plate 213. The metal water inlet 221 penetrates through the first heat shield 214 and communicates with the metal cover plate 213 and the steam tank 2151. One end of the temperature sensor 216 is electrically connected with a control panel 217, the control panel 217 is provided with a display screen 2171, a temperature control chip 2172, a function switch key and a corresponding drive circuit, and the display screen 2171 and the function switch key penetrate through the shell of the upper clamping assembly 2. The control panel 217 is installed above the first heat shield 214, and it is more convenient for users to check and set the working state of the machine by setting the display screen 2171. One side of the control panel 217 is provided with a battery assembly 219, and the battery assembly 219 includes one or more batteries 2191, a battery protection plate 2192 installed on one side of the batteries 2191 and electrically connected with a charging socket 218. The battery protection plate 2192 can effectively protect the batteries 2191 from overcharge, overdischarge, overcurrent and short circuit, and the batteries 2191 can be charged in real time by using the charging socket 218, which is very convenient. The device main body 1 further comprises a water pump 220, and the water outlet port of the water pump 220 is connected with a metal water inlet 221 through a connecting pipeline. After the device main body 1 is started. When the temperature control chip 2172 on the control panel 217 detects that the temperature on the metal heat conductor 211 is lower than the set temperature through the temperature sensor 216, the first heating plate 212 starts to work. When the temperature on the metal heat conductor 211 is higher than 100 degrees, the control panel 217 reduces the working current of the first heating plate 212 through an adaptive driving circuit, and when the temperature on the metal heat conductor 211 reaches 150-180 degrees. The first heating plate 212 stops working, and at this time, the water pump 220 is started to pump water into the steam generator 21, and the water is vaporized at high temperature to generate steam, which is then ejected from the air holes on the upper steam ironing board 215 to prevent the hair from being damaged by dry ironing. After the water enters the steam generator 21, it flows along the water tank 2111 on the metal heat conductor 211. By arranging a plurality of water tanks 2111, the lengths of the water tanks 2111 are extended. Vaporize the water more completely, and prevent the human body from being scalded by the unvaporized high-temperature water. At the same time, it is safer and more convenient to drive the first heating plate 212 with low voltage and use the batteries 2191.

As shown in FIGS. 1-5, the device main body 1 further comprises a water tank 222, and the water tank 222 is connected with the water inlet port of the water pump 220. The water tank 222 is installed at one side of the battery assembly 219, and the water in the water tank 222 is pumped by the water pump 220 to the metal heat conductor 211 in the first heat shield 214 through a connected pipeline, so that the water can be gasified into steam at high temperature. The lower clamping assembly 3 includes a bottom shell 31, and a lower steam ironing board 32 is installed on the upper surface of the bottom shell 31 at a position corresponding to the upper steam ironing board 215. The surface parts of the lower steam ironing board 32 and the upper steam ironing board 215 are both provided with a plurality of ventilation through holes. A second heating plate 33 is installed below the lower steam ironing board 32, and the working voltage of the second heating plate 33 is set to 11-13V. A second heat shield 34 is installed outside the second heating plate 33, and a plurality of holes are also formed in the second heat shield 34, which are communicated with the air-permeable through holes on the lower steam ironing board 32. A negative ion generator 35 is also arranged below the second heat shield 34, and the negative ion generator 35 is electrically connected with the control panel 217. The negative ions released by the negative ion generator 35 can not only smooth the short-tempered hair, but also neutralize the static electricity and retain the moisture in the hair. By arranging a plurality of groups of air holes, the generated water vapor and negative ions can be conveyed to the hair clamped in the lower steam ironing board 32 and the upper steam ironing board 215. The metal cover plate 213 of that metal water inlet 221 is fixedly connected by threads. The metal cover plate 213 is matched with the steam tank 2151, and the metal cover plate 213 is sealed and fixed on the steam tank 2151 by high-temperature resistant glue. The lower steam ironing board 32 and the upper steam ironing board 215 are arranged as flat-plate structures which are attached to each other up and down. The lower steam ironing board 32 and the upper steam ironing board 215 can also be arranged as arc-shaped structures which are convex at the top and concave at the bottom and are meshed with each other. The lower steam ironing board 32 is matched with the upper steam ironing board 215. The device main body 1 is specifically designed as a hair straightener device and/or a hair curler device, so that consumers have more choices.

The work principle of that invention is as follows: when in use, firstly, by press the function switch on the control panel 217, the device main body 1 starts to work, at this time, the temperature can be adjusted by the function switch. When the temperature control chip 2172 on the control panel 217 detects that the temperature on the metal heat conductor 211 is lower than the set temperature through the temperature sensor 216 installed on the metal cover plate 213. The first heating plate 212 starts to work. When the temperature on the metal heat conductor 211 is higher than 100 degrees, the control panel 217 reduces the working current of the first heating plate 212 through an adaptive drive circuit (the drive control circuit belongs to the prior art and will not be described in detail here). When the temperature on the metal heat conductor 211 reaches 150-180 degrees, the first heating plate 212 stops working, and at this time, the water pump 220 starts to pump water into the steam generator 21, so that the water can be gasified more thoroughly in the cavity, effectively preventing the unvgasified high-temperature water in the cavity from flowing out and scalding the human body;

After the water enters the steam generator 21, it flows along the water tanks 2111 on the metal heat conductor 211, and a plurality of water tanks 2111 are horizontally and vertically arranged on the surface and bottom of the metal heat conductor 211. One or more water tanks 2111 are also horizontally and vertically arranged on both sides of the metal heat conductor 211; extending the lengths of the water tanks 2111 to vaporize the water more completely, so as to prevent the human body from being scalded by the unvaporized high-temperature water;

By installing the negative ion generator 35 on the lower steam ironing board 32 in the lower clamping assembly 3, in use, the negative ions released by the negative ion generator 35 can smooth rough hair, and at the same time, the negative ions released by the negative ion generator 35 can neutralize static electricity to retain moisture in the hair. By arranging a plurality of groups of air holes, the generated water vapor and negative ions can be conveyed to the hair clamped in the lower steam ironing board 32 and the upper steam ironing board 215.

In the invention, both the device main body 1 and the upper clamping assembly 2 operate at a low voltage of 11-13V, which is safer in use, and the built-in battery is used for power supply, which is convenient to use.

The above is only the preferred embodiment of the invention, and it is not used to limit the invention. Any modification, equivalent substitution, improvement, etc. made within the spirit and principle of the invention should be included in the protection scope of the invention.

What is claimed is:

1. An electric storage type hair steam perm structure comprises a device main body, wherein the device main body comprises an upper clamping assembly component and a lower clamping assembly which is rotatably connected with a rotating shaft of the upper clamping assembly;

a steam generator is provided in a shell of the upper clamping assembly;

the steam generator comprises an upper steam ironing board, and a steam tank is arranged on the upper steam ironing board, a bottom of the steam tank is provided with a plurality of groups of air holes, and a metal heat conductor is arranged in the steam tank an inside of the metal heat conductor is provided with a cavity, a first heating plate is provided in the cavity, and a metal cover plate is arranged above the metal heat conductor;

an upper surface and a bottom of the metal heat conductor provided with an arrangement of a plurality of water tanks;

two sides of the metal heat conductor are provided with one or more water tanks;

a working voltage of the first heating plate is set to 11-13V;

a first heat shield is arranged on the metal cover plate;

an upper surface of the first heat shield is provided with a temperature sensor and a metal water inlet, the temperature sensor penetrates through the first heat shield and contacts the metal cover plate, a metal water inlet penetrates through the first heat shield and communicates with the metal cover plate and the steam tank;

one end of the temperature sensor is electrically connected with a control panel, and a display screen is installed on the control panel, a temperature control chip, a function switch key and an adaptive drive circuit, wherein the display screen and the function switch key penetrate the shell of the upper clamping assembly, and the control panel is installed above the first heat shield;

one side of the control panel is provided with a battery assembly, the battery assembly comprises one or more batteries, a battery protection plate installed at one side of the one or more batteries and electrically connected with a charging socket;

the steam generator further comprises a water pump, and a water outlet port of the water pump is connected with the metal water inlet through a connecting pipeline;

after the device main body is started, when the temperature control chip on the control panel detects that a temperature on the metal heat conductor is lower than a set temperature through the temperature sensor, the first heating plate starts to work when the temperature on the metal heat conductor is higher than 100 degrees, the control panel reduces a working current of the first heating plate through an adaptive driving circuit when the temperature on the metal heat conductor reaches 150-180 degrees, the first heating plate stops working, and the water pump starts pumping water into the steam generator, vaporizing the water at high temperature to generate steam, and then spraying it from the plurality of groups of air holes on the upper steam ironing board to prevent hair from being damaged by dry ironing;

after the water flows into the steam generator, the water flows along the plurality of water tanks on the metal heat conductor, the arrangement of the plurality of water tanks, extend total lengths of the plurality of water tanks, the water is vaporized completely and configured to prevent scalding due to unvaporized high-temperature water;

the low voltage drives the first heating plate and the one or more batteries.

2. The electric storage type hair steam perm structure according to claim 1, wherein the device main body further comprises the water tanks, the water tanks are connected with a water inlet port of the water pump, and the water tanks are installed at one side of the battery assembly.

3. The electric storage type hair steam perm structure according to claim 1, wherein the lower clamping assembly comprises a bottom shell, an upper surface of the bottom shell is provided with a lower steam ironing board at a position corresponding to the upper steam ironing board; a surface of the lower steam ironing board is provided with a plurality of ventilation through holes.

4. The electric storage type hair steam perm structure according to claim 3, wherein a second heating plate is installed below the lower steam ironing board, and a working voltage of the second heating plate is set to 11-13V.

5. The electric storage type hair steam perm structure according to claim 4, wherein a second heat shield is installed outside the second heating plate, and a plurality of holes are formed in the second heat shield, which communicate with air-permeable through holes on the lower steam ironing board.

6. The electric storage type hair steam perm structure according to claim 5, wherein negative ion generator is arranged below the second heat shield, and the negative ion generator is electrically connected with the control panel.

7. The electric storage type hair steam perm structure according to claim 1, wherein the metal water inlet is fixedly connected with the metal cover plate by screw thread.

8. The electric storage type hair steam perm structure according to claim 1, wherein the metal cover plate is matched with the steam tank, and the metal cover plate is sealed and fixed on the steam tank by high-temperature resistant glue.

9. The electric storage type hair steam perm structure according to claim 1, wherein the lower steam ironing board and the upper steam ironing board are arranged as flat-plate structures;

the lower steam ironing board and the upper steam ironing board configured to be arranged as arc-shaped structures which are convex at a top and concave at a bottom and are mutually meshed; the lower steam ironing board is matched with the upper steam ironing board.

10. The electric storage type hair steam perm structure according to claim 1, wherein the device main body is configured to be a hair straightener device and/or a hair curler device.

* * * * *